US007764888B2

(12) United States Patent
Hagiwara et al.

(10) Patent No.: US 7,764,888 B2
(45) Date of Patent: Jul. 27, 2010

(54) IMAGE FORMATION APPARATUS AND CHARGING CONTROL METHOD OF CHARGING ROLL

(75) Inventors: Takuro Hagiwara, Kanagawa (JP); Yoshihisa Kitano, Kanagawa (JP); Osamu Handa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 959 days.

(21) Appl. No.: 11/541,550

(22) Filed: Oct. 3, 2006

(65) Prior Publication Data

US 2007/0189787 A1 Aug. 16, 2007

(30) Foreign Application Priority Data

Feb. 14, 2006 (JP) ..... P2006-036408

(51) Int. Cl.
*G03G 15/00* (2006.01)
*G03G 15/02* (2006.01)

(52) U.S. Cl. ..... 399/44; 399/50

(58) Field of Classification Search ..... 399/44, 399/48, 50

See application file for complete search history.

(56) References Cited

U.S. PATENT DOCUMENTS 5,485,248 A * 1/1996 Yano et al. ..... 399/73
5,911,097 A * 6/1999 Haga et al. ..... 399/174
6,615,002 B2 * 9/2003 Saito et al. ..... 399/43

FOREIGN PATENT DOCUMENTS

JP 10-198131 7/1998
JP 2004-333789 11/2004

* cited by examiner

*Primary Examiner*—David M Gray
*Assistant Examiner*—Gregory H Curran
(74) *Attorney, Agent, or Firm*—Morgan, Lewis & Bockius LLP

(57) ABSTRACT

An image formation apparatus includes: a photoconductor that has a photoconductive layer having a surface on which an electrostatic latent image is formed; a charging roll to which a bias with an AC component superposed on a DC component is applied for charging the photoconductor at a predetermined potential; a film thickness detector that detects a film thickness of the photoconductive layer of the photoconductor without applying the AC component; an environment measuring section that measures at least one of ambient temperature and humidity; an AC component setting section that sets a value of the AC component of the bias based on detection results of the film thickness detector and the environment measuring section; and a charging controller that controls at least one of voltage and current applied to the charging roll based on the value of the AC component set by the AC component setting section.

7 Claims, 4 Drawing Sheets

IMAGE FORMATION APPARATUS AND CHARGING CONTROL METHOD OF CHARGING ROLL

BACKGROUND (i) Technical Field

This invention relates to an electrophotographic image formation apparatus and a control method thereof and in particular to an image formation apparatus and a charging control method of a charging roll for prolonging the life of a photoconductor and preventing an image defect accompanying abrasion of a photoconductor.

(ii) Related Art

Hitherto, in an image formation apparatus based on contact electrification, prolonging the life of a conductor has been a problem with the demand for stably prolonging the life of a conductor independently of the environment, the use frequency, the lot difference, etc.

SUMMARY

According to an aspect of the invention, an image formation apparatus includes: a photoconductor that has a photoconductive layer having a surface on which an electrostatic latent image is formed; a charging roll to which a bias with an AC component superposed on a DC component is applied for charging the photoconductor at a predetermined potential; a film thickness detector that detects a film thickness of the photoconductive layer of the photoconductor without applying the AC component; an environment measuring section that measures at least one of ambient temperature and humidity; an AC component setting section that sets a value of the AC component of the bias based on detection results of the film thickness detector and the environment measuring section; and a charging controller that controls at least one of voltage and current applied to the charging roll based on the value of the AC component set by the AC component setting section.

BRIEF DESCRIPTION OF THE DRAWINGS

Exemplary embodiments of the present invention will be described in detail based on the following figure, wherein.

DETAILED DESCRIPTION

First Exemplary Embodiment

Referring now to the accompanying drawings, there are shown exemplary embodiments of the invention.

Figure 1:
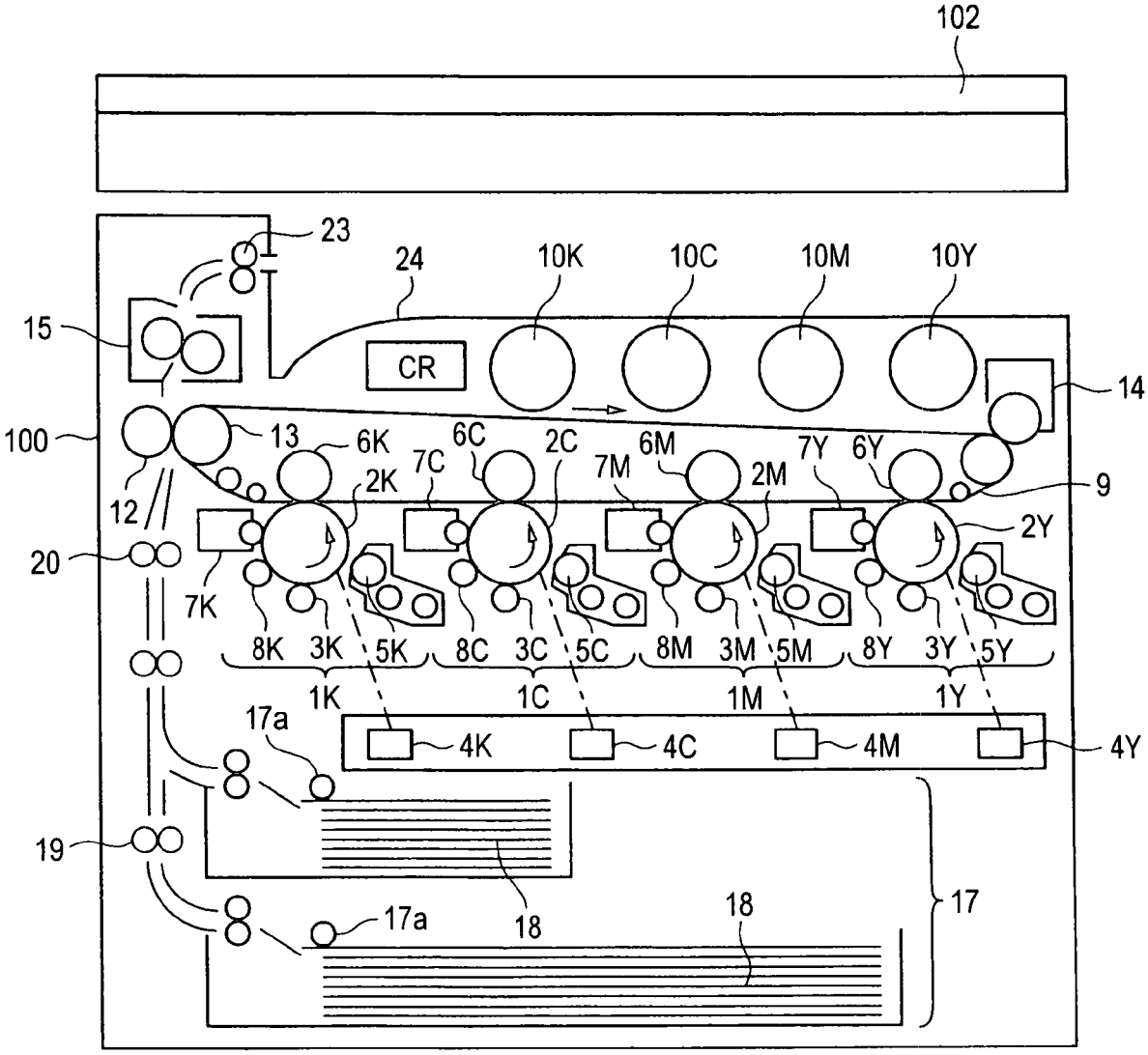
FIG. 1 is a schematic drawing to show the configuration of one embodiment of an image formation apparatus according to the invention.

To begin with, the schematic configuration of an image formation apparatus according to a first exemplary embodiment of the invention will be discussed with reference to FIG. 1. FIG. 1 is a schematic drawing to show the configuration of a tandem color image formation apparatus 100 according to the invention.

In the image formation apparatus 100, color image information of a color original read through an image reader 102, color image information, etc., sent from a personal computer (not shown), an image data input unit (not shown), etc., is input and image processing is performed for the input image information.

In FIG. 1, 1Y, 1M, 1C, and 1K denote image formation units for forming yellow (Y), magenta (M), cyan (C), and black (K) color toner images respectively and are disposed in series in this order along the traveling direction of an endless intermediate transfer belt 9 stretched on a plurality of tension rolls. The intermediate transfer belt 9 is an intermediate transfer body to which color toner images formed in order by the image formation units 1Y, 1M, 1C, and 1K are transferred in a superposition state on each other. It is inserted between photoconductor drums 2Y, 2M, 2C, and 2K of electrostatic latent image supports corresponding to the image formation units 1Y, 1M, 1C, and 1K and primary transfer rolls 6Y, 6M, 6C, and 6K disposed facing the photoconductor drums 2Y, 2M, 2C, and 2K and is formed so as to be able to circulate in the arrow direction. The color toner images multiple-transferred onto the intermediate transfer belt 9 are in batch transferred onto record paper 18 as a record medium fed from a paper cassette 17, etc., and then are fixed on the record paper 18 by a fuser 15 and the record paper 18 on which a color image is formed is ejected to the outside. Symbol CR denotes an apparatus controller made up of a CPU, ROM, RAM, etc., for controlling whole processing in the image formation apparatus 100.

The image reader 102 illuminates an original placed on platen glass with a light source (not shown) and reads a reflected light image from the original at a predetermined resolution by an image read device of a CCD sensor, etc., through a scanning optical system.

Each image formation unit 1Y, 1M, 1C, 1K is configured likewise and is roughly made up of the photoconductor drum 2Y, 2M, 2C, 2K for rotating predetermined rotation speed along the arrow direction, a charging roll 3Y, 3M, 3C, 3K as a charging section for uniformly charging the surface of the photoconductor drum 2Y, 2M, 2C, 2K, an exposure device 4Y, 4M, 4C, 4K for exposing an image corresponding to each color for forming an electrostatic latent image on the surface of the photoconductor drum 2Y, 2M, 2C, 2K, a developing device 5Y, 5M, 5C, 5K for developing the electrostatic latent image formed on the photoconductor drum 2Y, 2M, 2C, 2K, a toner cartridge 10Y, 10M, 10C, 10K being detachably disposed for supplying predetermined color toner to the developing device 5Y, 5M, 5C, 5K, a cleaning device 7Y, 7M, 7C, 7K, and the like.

Further, in the exemplary embodiment, the photoconductor drum 2Y, 2M, 2C, 2K is coated with a photoconductive layer made of an organic photoconductive material, an amorphous selenium-based photoconductive material, an amorphous silicon-based photoconductive material, etc., on the surface of metal drum rotating in the arrow direction, and the charging roll 3Y, 3M, 3C, 3K comes in contact with the surface of the photoconductor drum 2Y, 2M, 2C, 2K and charges the photoconductive layer at a predetermined potential by a bias having an AC component superposed on a DC component.

The image formation process in the described image formation apparatus will be discussed by taking the image formation unit 1Y for forming a yellow toner image as a representative example.

First, as a bias having an AC component superposed on a predetermined DC component is applied to the charging roll 3Y, the surface (photoconductive layer) of the photoconductor drum 2Y is uniformly charged. Next, for example, scan exposure corresponding to a yellow image is executed by a laser beam output from the exposure device 4Y based on the image information read through the image reader 102, and an electrostatic latent image corresponding to the yellow image is formed on the surface (photoconductive layer) of the photoconductor drum 2Y.

The electrostatic latent image corresponding to the yellow image is made a yellow toner image by the developing device 5Y and the yellow toner image is primarily transferred onto the intermediate transfer belt 9 by the pressure welding force and electrostatic suction force of the primary transfer roll 6Y forming a part of a primary transfer section. The yellow toner remaining on the photoconductor drum 2Y after the primary transfer is scraped by the drum cleaning device 7Y. After this, electricity on the surface of the photoconductor drum 2Y is eliminated by a static eliminator 8Y and then is again charged by the charging roll 3Y for the next image formation cycle.

In the image formation apparatus 100 for forming a multicolor image, the image formation process similar to that described above is also executed in the image formation units 1M, 1C, and 1K at the timings considering the relative position difference among the image formation units 1Y, 1M, 1C, and 1K, and a full color toner image is formed the intermediate transfer belt 9 in a superposition state. As the intermediate transfer belt 9, for example, a synthetic resin film of polyimide, etc., having flexibility is formed like a belt and both ends of the synthetic resin film formed like a belt are connected by means of welding, etc., whereby an endless belt is formed.

The full color toner image primarily transferred onto the intermediate transfer belt 9 is secondarily transferred onto the record paper 18 transported to a secondary transfer position at a predetermined timing by the pressure welding force and electrostatic suction force of a backup roll 13 for supporting the intermediate transfer belt 9 and a secondary transfer roll 12 for being pressed against the backup roll 13 at a predetermined timing.

On the other hand, the record paper 18 of a predetermined size is fed by a paper feed roll 17*a* from the paper cassette 17 as a record paper storage section placed at the bottom of the image formation apparatus 100. The fed record paper 18 is transported to the secondary transfer position of the intermediate transfer belt 9 at a predetermined timing by a plurality of transport rolls 19 and a plurality of registration rolls 20. The full color toner image is transferred to the record paper 18 in batch from the intermediate transfer belt 9 by the backup roll 13 and the secondary transfer roll 12 as a secondary transfer section as described above.

The record paper 18 to which the full color toner image is secondarily transferred from the intermediate transfer belt 9 is detached from the intermediate transfer belt 9 and then is transported to the fuser 15 disposed downstream from the secondary transfer section and the toner image is fixed onto the record paper 18 by heat and pressure by the fuser 15. The record paper 18 after the toner image is fixed is ejected to an ejection tray 24 through an ejection roll 23.

Further, the remaining toner on the intermediate transfer belt 9 that cannot be transferred onto the record paper 18 by the secondary transfer section is transported to a belt cleaning device 14 intact in a state in which the remaining toner is deposited on the intermediate transfer belt 9, and is removed from the intermediate transfer belt 9 by the belt cleaning device 14 for the next image formation.

By the way, in the described image formation apparatus, when a bias is applied to the charging roll 3Y, 3M, 3C, 3K, discharge occurs between the charging roll 3Y, 3M, 3C, 3K and the photoconductor drum 2Y, 2M, 2C, 2K corresponding thereto, causing the photoconductor drum 2Y, 2M, 2C, 2K to be charged at a predetermined potential.

When the bias is applied, particularly if the AC component is increased, the photoconductor surface is damaged like a flaw due to the amplitude of the AC component, abrasion of the photoconductor drum 2Y, 2M, 2C, 2K is promoted, and the life of the photoconductor drum 2Y, 2M, 2C, 2K is shortened.

On the other hand, if the AC component in the bias is lessened, a charging failure occurs like a spot and a white-spot image defect occurs.

Then, in the image formation apparatus according to the invention, while occurrence of an image defect is prevented in response to the film thickness and the ambient temperature/humidity of the photoconductor drum 2, the optimum AC component for suppressing abrasion of the photoconductor drum 2, namely, the lower limit value of the AC bias component at which an image defect accompanying a charging failure does not occur (which will be hereinafter also referred to as optimum AC bias value $AC_{opt}$) is set and the AC component in the bias applied to the charging roll 3 is changed based on the optimum AC bias value $AC_{opt}$.

Figure 2:
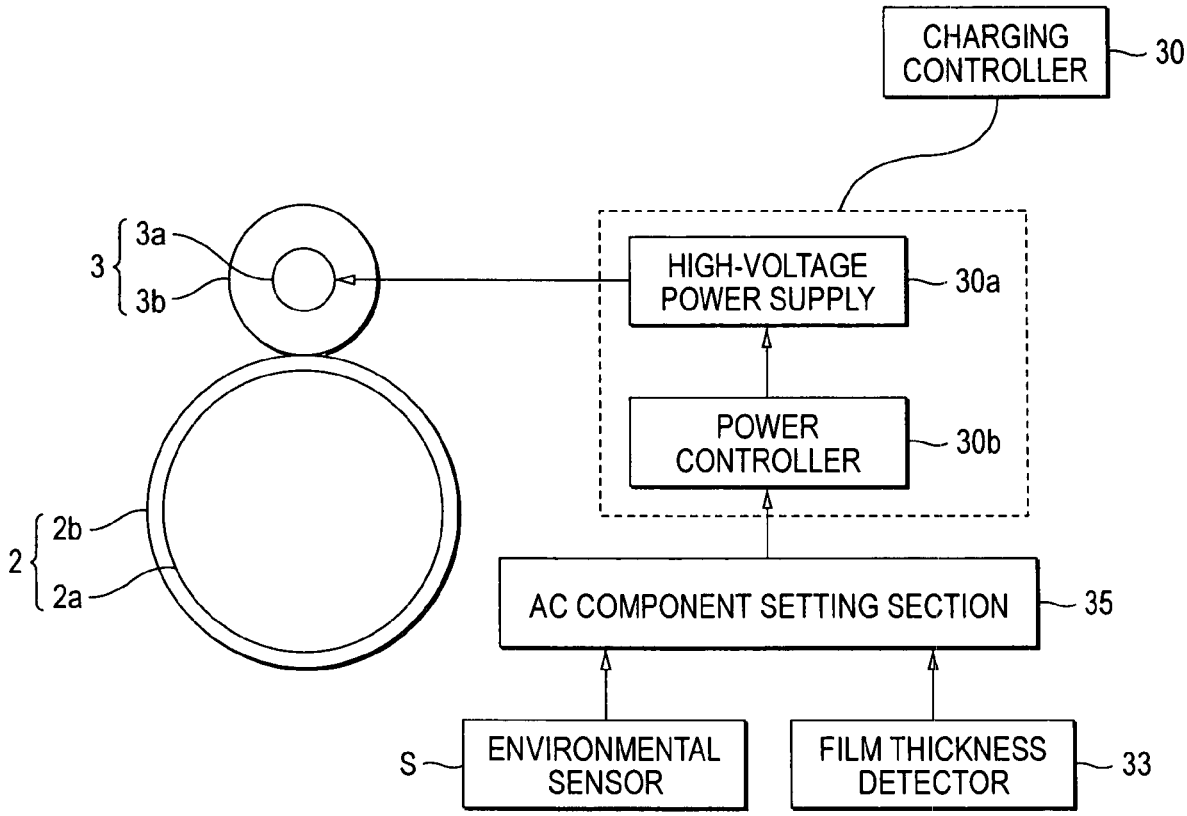
FIG. 2 is a block diagram to schematically show the configuration of charging control according to the invention.

Next, the charging control in the described image formation apparatus according to the invention will be discussed with reference to FIG. 2. FIG. 2 is a block diagram to schematically show the configuration of the charging control according to the invention. The image formation units 1Y, 1M, 1C, and 1K have each the similar configuration and their components (for example, the photoconductor drums 2Y, 2M, 2C, and 2K) also have the similar configurations and therefore the reference numerals are described as generic numerals (for example, the photoconductor drum 2) for simplicity.

As shown in FIG. 2, the image formation apparatus according to the exemplary embodiment includes the contact type charging roll 3 for coming in contact with the surface of the photoconductor drum 2, namely, a photoconductive layer 2*b* formed on a drum core 2*a*, the charging roll 3 to which a predetermined bias is supplied, a charging controller 30 made up of a high-voltage power supply 30*a* for supplying the bias to the charging roll 3 and a power controller 30*b* for controlling the supply voltage/current of the high-voltage power supply 30*a*, an environmental sensor S for measuring the temperature and the humidity in the apparatus, a film thickness detector 33 for detecting the film thickness of the photoconductive layer 2*b* of the photoconductor drum 2, and an AC component setting section 35 for setting the optimum AC bias value to prevent occurrence of an image defect while suppressing abrasion of the photoconductive layer 2*b* based on the outputs of the environmental sensor S and the film thickness detector 33. For example, an already known temperature/humidity sensor can be used as the environmental sensor S.

The charging roll 3 is provided by coating a conductive layer 3*b* made of a conductive synthetic resin, conductive synthetic rubber, etc., with the resistance value adjusted to a predetermined value on the surface of a cored bar 3*a* made of metal such as stainless steel, and a mold release layer is formed on the surface of the conductive layer 3*b* as required. For example, AC voltage on which DC voltage is superposed is applied to the cored bar 3*a* by the high-voltage power supply 30*a*, whereby gap discharge is caused to occur in a minute gap between the charging roll 3 and the photoconductor drum 2, thereby charging the surface of the photoconductor drum 2.

In the exemplary embodiment, the contact type charging roll 3 is illustrated, but the invention is not limited to the contact type charging roll 3 and can also be applied to a non-contact type charging roll.

In the exemplary embodiment, the bias applied to the charging roll 3 is AC component (voltage/current) superposed on DC voltage (voltage/current); specifically, for example, the DC bias voltage is set to −800 VDC to −700 VDC roughly equal to the charge potential of the photoconductor drum 2, the AC bias voltage is set to 1.5 to 2.5 k VAC, and the frequency is set to 1.3 to 1.5 kHz.

When detecting the film thickness of the photoconductive layer 2*b* of the photoconductor drum 2 as described below, the film thickness detector 33 according to the exemplary embodiment easily detects the film thickness of the photoconductive layer 2*b* without applying an AC component, thereby making it possible to skip the process of applying an AC bias for detecting the film thickness and suppress abrasion of the photoconductor drum 2 more effectively.

Generally, it is known that there is a linear correlation between the film thickness of the photoconductive layer and the charge amount. Then, based on the correlation, the film thickness detector 33 calculates the film thickness responsive to the use state according to the ratio between the initial charge amount of the photoconductor drum 2 and the charge amount growing in response to the use (in response to abrasion of the film thickness), for example.

Specifically, when the film thickness is detected, only a DC bias is applied to the photoconductor drum 2 and the charge amount is detected at the time, whereby the ratio between the charge amount and the initial charge amount is found and the initial film thickness is multiplied by the found ratio, whereby the film thickness in the use state can be easily detected (calculated).

Thus, the film thickness detector 33 easily detects the film thickness without applying an AC bias, whereby it is made possible to skip the former process of rotating the photoconductor drum 2 and applying an AC bias, suppress extra abrasion of the photoconductor drum 2, and detect the film thickness according to the simple configuration.

The film thickness detector 33 may detect the film thickness based not only on the charge amount described above, but also on the value of the DC current flowing between the charging roll 3 and the photoconductor drum 2, for example. In this case, the detection accuracy is degraded as compared with that based on the charge amount, but an inexpensive current measuring circuit can be used.

It is also known that the film thickness of the photoconductor drum 2 has a correlation with the charging history of the photoconductor drum 2. Thus, the film thickness detector 33 may be configured so as to detect the film thickness based on the charging history information of the photoconductor drum 2, for example. The measurement result of an already known number-of-print-sheets counter or an already known counter of the cumulative number of revolutions of the photoconductor drum 2 can be used as the charging history information of the photoconductor drum 2, for example.

To thus detect the film thickness of the photoconductive layer 2*b* based the charging history information of the photoconductor drum 2, the need for applying a DC bias is also eliminated and thus, for example, if a minute leak not affecting image formation occurs in the photoconductor drum 2, the film thickness can be detected appropriately.

Further, the AC component setting section 35 according to the invention is configured so as to set the optimum AC bias value $AC_{opt}$ to enable compatibility between prevention of an image defect and suppression of abrasion of the photoconductor drum 2 based on the outputs of the environmental sensor S and the film thickness detector 33.

Generally, the optimum AC bias value $AC_{opt}$ to prolong the life of the photoconductor drum 2 without adding a stress to the photoconductor drum 2 and prevent a charging failure caused by insufficient charging changes with the photoconductor film thickness.

The surface potential of the photoconductor drum 2 is determined by a DC bias (DC voltage/current). Specifically, the surface potential of the photoconductor drum 2 grows with an increase in an AC bias (AC voltage/current) until the AC bias becomes an amplitude about twice the discharge start voltage derived according to Paschen's law, and when the AC bias exceeds the amplitude about twice the discharge start voltage, the surface potential of the photoconductor drum 2 converges to a potential roughly equal to the applied DC bias (given potential).

It is known that the optimum AC bias value $AC_{opt}$ to prevent abrasion of the photoconductor caused by applying an excessive AC bias and prevent occurrence of an image defect caused by applying a too small AC bias is a value resulting from multiplying an AC component value when the surface potential of the photoconductor drum 2 is saturated and converges to a value roughly equal to the DC component value of the bias (which will be hereinafter also referred to as saturated AC reference value $AC_{sat}$) by a predetermined correction value $AC_{rev}$ changing with the photoconductor film thickness and the ambient temperature/humidity.

Further, it turned out by research of the inventor et al. that the AC bias value when the DC bias is saturated (saturated AC reference value $AC_{sat}$) has the following predetermined correlation with the photoconductor film thickness and the ambient temperature/humidity:

Specifically, letting the saturated AC reference value be $AC_{sat}$ (mA), the photoconductor film thickness be d(μm), and an environmental compensation coefficient based on the absolute humidity (g/l) be α, it turned out that there is the following relation:

$$AC_{sat} \approx \alpha d^{-1/2} \quad \text{(Expression 1)}$$

The AC component setting section 35 in the exemplary embodiment sets the optimum AC bias value $AC_{opt}$ to prevent an image defect and suppress abrasion of the photoconductor drum 2 based on the measurement results of the environmental sensor S and the film thickness detector 33 by multiplying the saturated AC reference value $AC_{sat}$ obtained based on the relational expression by the correction value $AC_{rev}$, and the charging controller 30 superposes the optimum AC bias value $AC_{opt}$ on a predetermined DC bias value based on the setting result of the AC component setting section 35 and applies the bias to the charging roll 3.

If such a correction value $AC_{rev}$ to actually prevent occurrence of an image defect is actually measured each time, the AC applying process is required repeatedly and unnecessary damage is given to the photoconductor drum 2 and the control becomes complicated. Then, the correction values $AC_{rev}$ are put into a database as a correction value table in response to the film thicknesses and the ambient temperatures/humidities and the saturated AC reference value $AC_{sat}$ is found according to the relational expression mentioned above based on the measurement results of the environmental sensor S and the film thickness detector 33 and then the correction value table is referenced and the saturated AC reference value $AC_{sat}$ is multiplied by the correction value $AC_{rev}$ to set the optimum AC bias value $AC_{opt}$.

To set the optimum AC bias value $AC_{opt}$, the saturated AC reference value $AC_{sat}$ based on the relational expression mentioned above is calculated appropriately in response to the measurement results of the environmental sensor S and the film thickness detector 33 and then the correction value $AC_{rev}$ may be taken into consideration for setting or the correlation between the optimum AC bias value $AC_{opt}$ and the photoconductor film thickness and the ambient temperature/humidity containing the saturated AC reference value $AC_{sat}$ based on the relational expression mentioned above and the correction value $AC_{rev}$ may be previously found and be put into an AC bias database, which may be appropriately referenced based on the measurement results of the environmental sensor S and the film thickness detector 33 and the optimum AC bias value $AC_{opt}$ may be directly set. The control function of the component section may be provided using the apparatus controller CR or may be provided using a dedicated controller, of course.

Second Exemplary Embodiment

Figure 3:
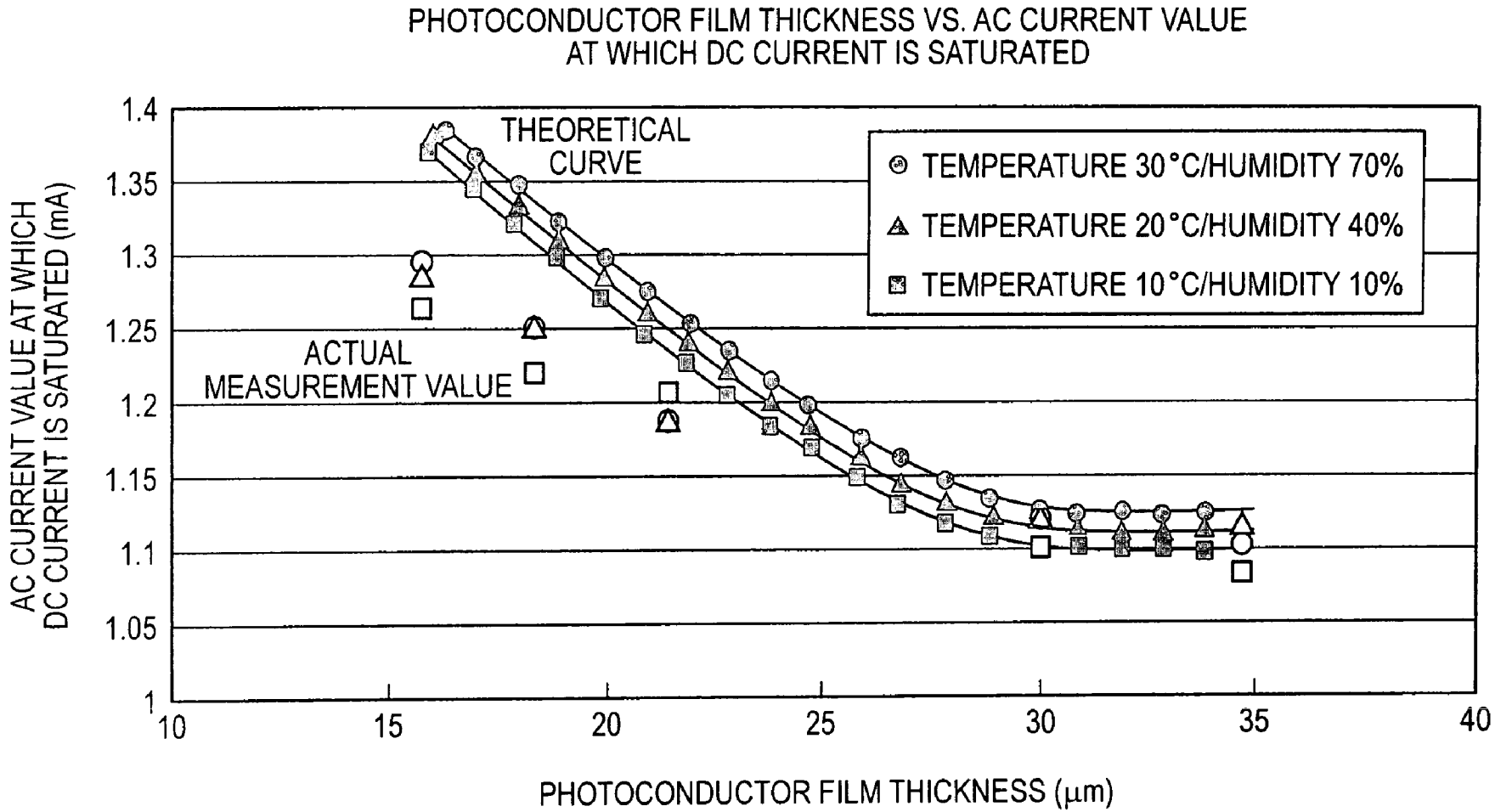
FIG. 3 is a drawing to show the trends of theoretical values and actual measurement values of saturated AC reference value.
Figure 4:
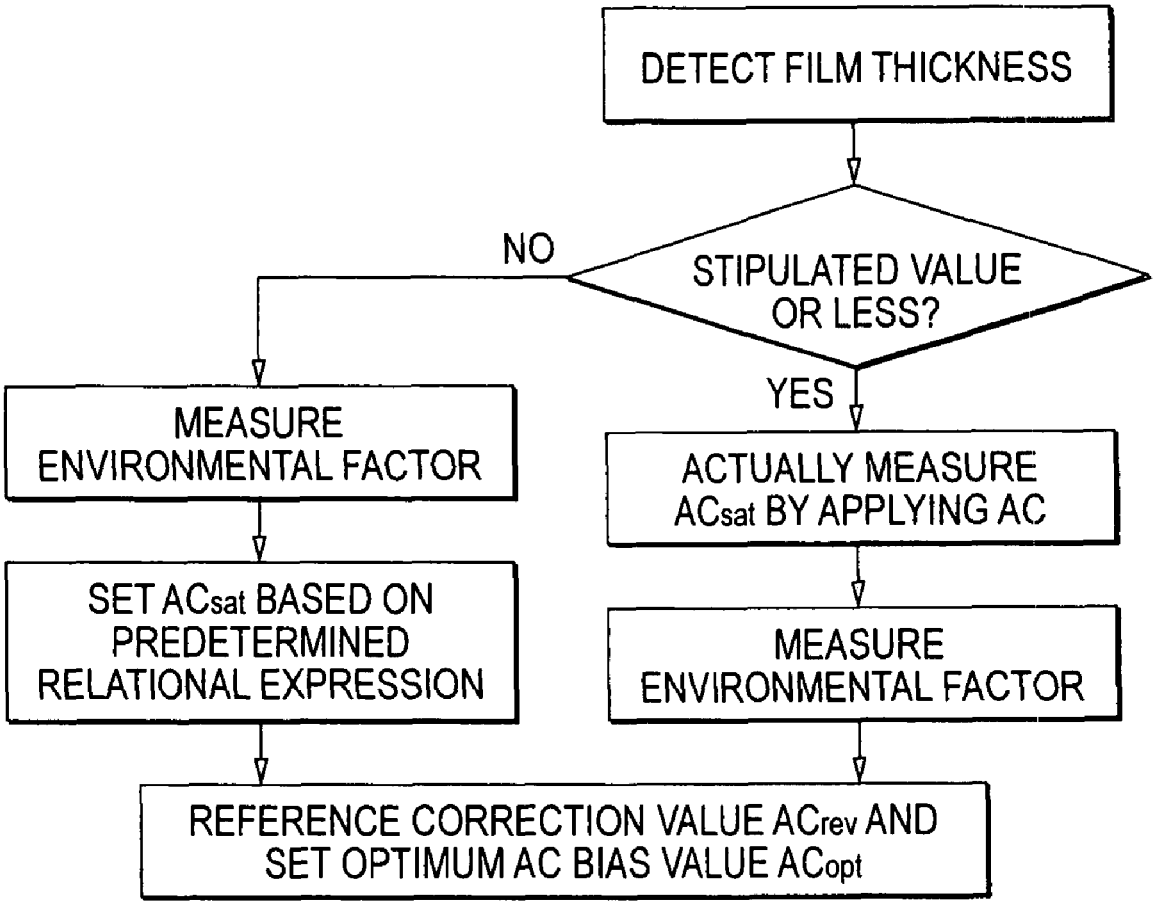
FIG. 4 is a flowchart to describe charging control according to the invention.

Next, another exemplary embodiment of charging control of image formation apparatus according to the invention will be discussed with reference to FIGS. 3 and 4. FIG. 3 is a drawing to show the relationship between theoretical curves and actual measurement values of saturated AC reference value $AC_{sat}$ and FIG. 4 is a flowchart to describe the charging control according to the exemplary embodiment. The charging control according to the exemplary embodiment is intended for improving the accuracy of optimum AC bias value $AC_{opt}$ and is simplified by executing actual measurement adopting minimum necessary AC application responsive to the film thickness and basically can be conducted according to a similar apparatus configuration to that in the first exemplary embodiment. Parts similar to those previously described in the first exemplary embodiment are denoted by similar reference numerals in the second exemplary embodiment and will not be discussed again.

It turned out by additional research of the inventor et al. that as for predetermined relationship among photoconductor film thickness d, ambient temperature/humidity, and saturated AC reference value $AC_{sat}$, the theoretical values and the actual measurement values match with accuracy when age abrasion from the initial state does not proceed before the photoconductor film thickness becomes a stipulated value of 70% to 80% of the initial film thickness (in the example, about 30 μm); however, when abrasion of a photoconductor drum 2 proceeds and the film thickness becomes equal to or less than the stipulated value, variations occur between the theoretical values and the actual measurement values with the progress of the abrasion, as shown in FIG. 3.

Then, considering the above-described correlation characteristic, the charging control according to the exemplary embodiment is intended for improving the setting accuracy of the optimum AC bias value $AC_{opt}$ responsive to the film thickness and is simplified. Specifically, if the film thickness detected (calculated) by a film thickness detector 33 exceeds the stipulated value (in the example, about 30 μm), an AC component setting section 35 sets the optimum AC bias value $AC_{opt}$ responsive to the photoconductor film thickness d and the ambient temperature/humidity based on the above-mentioned relational expression (theoretical curve) and only if the film thickness detected (calculated) by the film thickness detector 33 is equal to or less than the stipulated value, the AC component setting section 35 actually measures the AC component value at which the DC component value of the bias is saturated (saturated AC reference value $AC_{sat}$) and sets the optimum AC bias value $AC_{opt}$ based on the actually measured saturated AC reference value $AC_{sat}$.

To begin with, to perform the charging control according to the exemplary embodiment, the image formation apparatus includes a table listing a correction value $AC_{rev}$ by which the saturated AC reference value $AC_{sat}$ is to be multiplied for each ambient temperature/humidity and film thickness as in the first exemplary embodiment.

First, the film thickness detector 33 detects the film thickness of the photoconductive layer 2*b* of the photoconductor drum 2 in the use state and an environmental sensor S measures the ambient temperature/humidity at the time, as shown in FIG. 4.

Next, if the detection result of the photoconductor film thickness by the film thickness detector 33 exceeds the stipulated value (70% to 80% of the initial film thickness; in the example shown in FIG. 3, about 30 μm), the AC component setting section 35 sets the saturated AC reference value $AC_{sat}$ based on the above-mentioned relational expression and multiplies the saturated AC reference value $AC_{sat}$ by the correction value $AC_{rev}$ to set the optimum AC bias value $AC_{opt}$.

In such a film thickness area, the saturated AC reference value $AC_{sat}$ does not much change with the film thickness or the ambient temperature/humidity as shown in FIG. 3 and therefore the optimum AC bias value $AC_{opt}$ may be set simply by taking the correction value $AC_{rev}$ into consideration without changing the saturated AC reference value $AC_{sat}$ based on the initial saturated AC reference value $AC_{sat}$ (for example, AC 1.1 mA).

On the other hand, if the detection result of the film thickness by the film thickness detector 33 is equal to or less than the stipulated value, a bias voltage is applied to the photoconductor drum 2 so that it is gradually increased/decreased and the AC component when the DC component is saturated (saturated AC reference value $AC_{sat}$) is actually measured. The correction table is referenced based on the measurement result of the environmental sensor S and the actually measured saturated AC reference value $AC_{sat}$ is multiplied by the correction value $AC_{rev}$, thereby setting the optimum AC bias value $AC_{opt}$.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image formation apparatus comprising:

a photoconductor that comprises a photoconductive layer having a surface on which an electrostatic latent image is formed;

a charging roll to which a bias with an AC component superposed on a DC component is applied for charging the photoconductor at a predetermined potential;

a film thickness detector that detects a film thickness of the photoconductive layer of the photoconductor without applying the AC component;

an environment measuring section that measures at least one of ambient temperature and humidity;

an AC component setting section that sets a value of the AC component of the bias based on detection results of the film thickness detector and the environment measuring section; and a charging controller that controls the voltage or current applied to the charging roll based on the value of the AC component set by the AC component setting section;

wherein the AC component setting section sets the AC component of the bias based on the product of a value of the film thickness detected by the film thickness detector to the (−½)th power and an environmental compensation coefficient based on at least one of an ambient temperature and humidity measured by the environment measuring section.

2. The image formation apparatus as claimed in claim 1, wherein the film thickness detector detects the film thickness of the photoconductive layer based on a charge amount of the photoconductor at the time of detecting the film thickness.

3. The image formation apparatus as claimed in claim 1, wherein the film thickness detector detects the film thickness based on charging history information of the photoconductor.

4. An image formation apparatus comprising:

a photoconductor that comprises a photoconductive layer having a surface on which an electrostatic latent image is formed;

a charging roll to which a bias with an AC component superposed on a DC component is applied for charging the photoconductor at a predetermined potential;

a film thickness detector that detects a film thickness of the photoconductive layer of the photoconductor without applying the AC component;

an environment measuring section that measures at least one of ambient temperature and humidity;

an AC component setting section that sets a value of the AC component of the bias based on detection results of the film thickness detector and the environment measuring section; and a charging controller that controls the voltage or current applied to the charging roll based on the value of the AC component set by the AC component setting section;

wherein when a value of the film thickness detected by the film thickness detector exceeds a stipulated value, the AC component setting section sets a value of the AC component of the bias based on a predetermined correlation between (i) the at least one of measured ambient temperature and humidity, and the film thickness and (ii) an AC bias, and when the detected film thickness value is equal to or less than the stipulated value, the AC component setting section actually measures the AC component when the DC component is saturated by gradually increasing or decreasing the AC component and applying the AC component to the photoconductor and sets the AC component of the bias based on the actual measurement value.

5. A charging control method of a charging roll comprising:

providing a photoconductor that comprises a photoconductive layer having a surface on which an electrostatic latent image is formed and a charging roll to which a bias in which an AC component is superposed on a DC component is applied for charging the photoconductor at a predetermined potential;

detecting a film thickness of the photoconductive layer of the photoconductor and at least one of ambient temperature and humidity in a state where a mensurative bias having the DC component but no AC component is applied to the charging roll;

when the detected film thickness exceeds a stipulated value, setting a value of the AC component of the bias based on a predetermined correlation between (i) the detected film thickness and the at least one of ambient temperature and humidity and (ii) an AC bias, and applying the AC component to the charging roll; and when the detected film thickness value is equal to or less than the stipulated value, actually measuring the value of the AC component when the DC component is saturated, setting a value of the AC component of the bias based on the actual measurement value, and applying the AC component to the charging roll.

6. The image formation apparatus as claimed in claim 4, wherein the film thickness detector detects the film thickness of the photoconductive layer based on a charge amount of the photoconductor at the time of detecting the film thickness.

7. The image formation apparatus as claimed in claim 4, wherein the film thickness detector detects the film thickness based on charging history information of the photoconductor.

* * * * *